US006273831B1

(12) United States Patent
Dewanjee

(10) Patent No.: US 6,273,831 B1
(45) Date of Patent: Aug. 14, 2001

(54) GOLF CLUB HEAD WITH A POLYMER INSERT

(75) Inventor: Pijush Dewanjee, Oceanside, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/389,804

(22) Filed: Sep. 3, 1999

(51) Int. Cl.[7] ..... A63B 53/04

(52) U.S. Cl. ..... 473/324; 473/340; 473/342; 473/349; 273/DIG. 8

(58) Field of Search ..... 473/324, 325, 473/329, 332, 342, 340, 349, 350, 131, 313, 287, 290, 347, 348, 341; 273/DIG. 8

(56) References Cited

U.S. PATENT DOCUMENTS

| | | | |
|---|---|---|---|
| D. 408,881 | | 4/1999 | Solheim et al. . |
| 3,937,474 | | 2/1976 | Jepson et al. . |
| 3,975,023 | | 8/1976 | Inamori . |
| 3,989,248 | | 11/1976 | Campau . |
| 4,121,832 | | 10/1978 | Ebbing . |
| 4,252,262 | | 2/1981 | Igarashi . |
| 4,326,716 | | 4/1982 | Lacoste . |
| 4,422,638 | * | 12/1983 | Tucker . |
| 4,792,140 | | 12/1988 | Yamaguchi et al. . |
| 4,884,812 | | 12/1989 | Nagasaki et al. . |
| 5,078,398 | | 1/1992 | Reed et al. . |
| 5,083,778 | * | 1/1992 | Douglass . |
| 5,178,392 | | 1/1993 | Santioni . |
| 5,299,807 | | 4/1994 | Hutin . |
| 5,301,941 | | 4/1994 | Allen . |
| 5,303,922 | | 4/1994 | Lo . |
| 5,346,216 | | 9/1994 | Aizawa . |
| 5,358,249 | | 10/1994 | Mendralla . |
| 5,405,136 | | 4/1995 | Hardman . |
| 5,405,137 | | 4/1995 | Vincent et al. . |
| 5,417,419 | | 5/1995 | Anderson et al. . |
| 5,447,311 | | 9/1995 | Viollaz et al. . |
| 5,458,332 | | 10/1995 | Fisher . |
| 5,460,377 | | 10/1995 | Schmidt et al. . |
| 5,464,212 | | 11/1995 | Cook . |
| 5,465,968 | * | 11/1995 | Aizawa . |
| 5,485,997 | | 1/1996 | Schmidt et al. . |
| 5,524,331 | | 6/1996 | Pond . |
| 5,542,675 | | 8/1996 | Micciche et al. . |
| 5,575,472 | | 11/1996 | Magerman et al. . |
| 5,605,510 | | 2/1997 | Schmidt et al. . |
| 5,674,132 | | 10/1997 | Fisher . |
| 5,690,562 | | 11/1997 | Sturm . |
| 5,713,800 | | 2/1998 | Su . |
| 5,743,813 | | 4/1998 | Chen et al. . |
| 5,766,093 | | 6/1998 | Rohrer . |
| 5,766,094 | | 6/1998 | Mahaffey et al. . |
| 5,816,936 | | 10/1998 | Aizawa et al. . |
| 5,842,935 | | 12/1998 | Nelson . |
| 5,921,871 | | 7/1999 | Fisher . |
| 5,924,939 | | 7/1999 | Grace et al. . |
| 5,931,743 | | 8/1999 | Baker et al. . |
| 5,944,619 | | 8/1999 | Cameron . |
| 5,951,412 | | 9/1999 | Rose et al. . |

FOREIGN PATENT DOCUMENTS

| | | |
|---|---|---|
| 0891790 | 7/1998 | (EP) . |
| 09037121 | 8/1998 | (JP) . |

* cited by examiner

*Primary Examiner*—Sebastiano Passaniti
(74) *Attorney, Agent, or Firm*—Michael A. Catania

(57) ABSTRACT

The present invention is a golf club head having a club head body with a recess and an insert therein. The insert is composed of a thermoset polyurethane material having a shore D hardness in the range of 42 to 55, and a Bayshore rebound in the range of 51 to 60. The preferred thermoset polyurethane material is formed from a p-phenylene diisocyanate prepolymer and a curing agent. The golf club head is preferably a putter club head, however, it may be a wood club head or an iron club head. The particular thermoset polyurethane provides a soft striking face for feel and a good rebound for distance.

19 Claims, 9 Drawing Sheets

FIG. 3
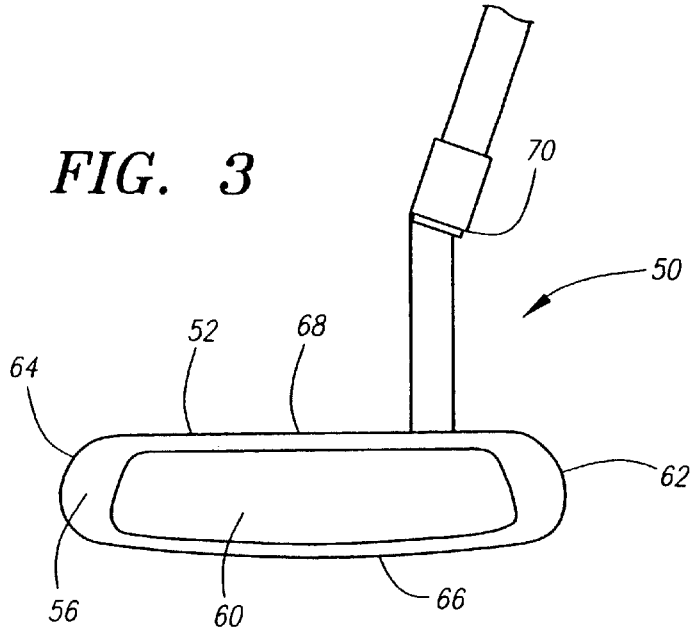
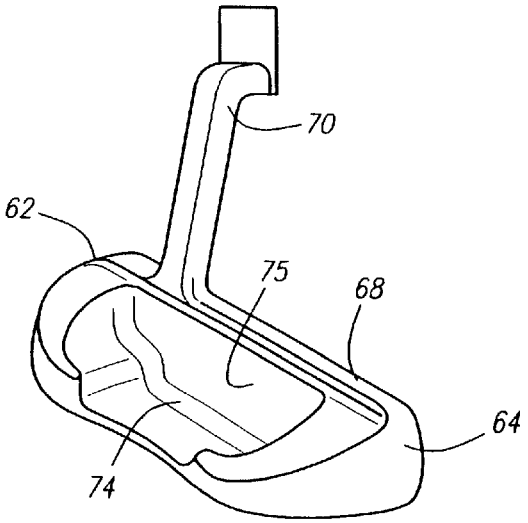
FIG. 3A
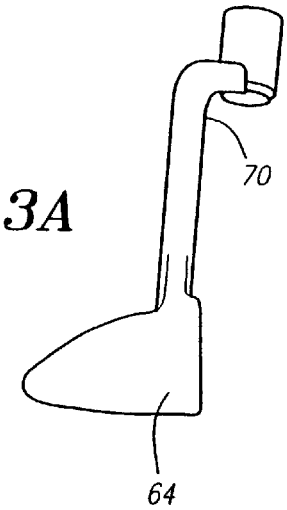
FIG. 3B
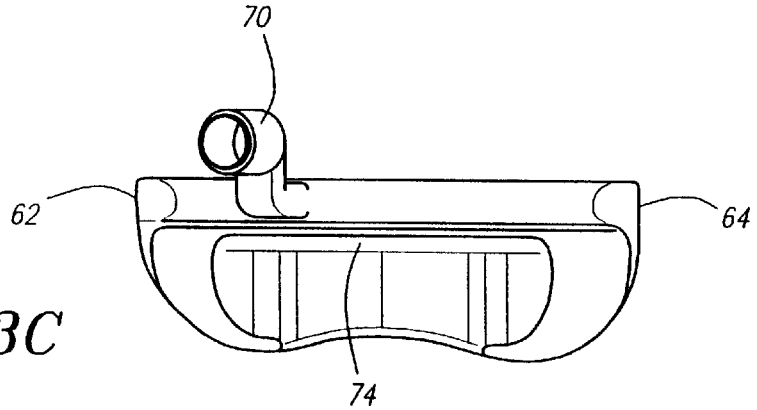
FIG. 3C

FIG. 5
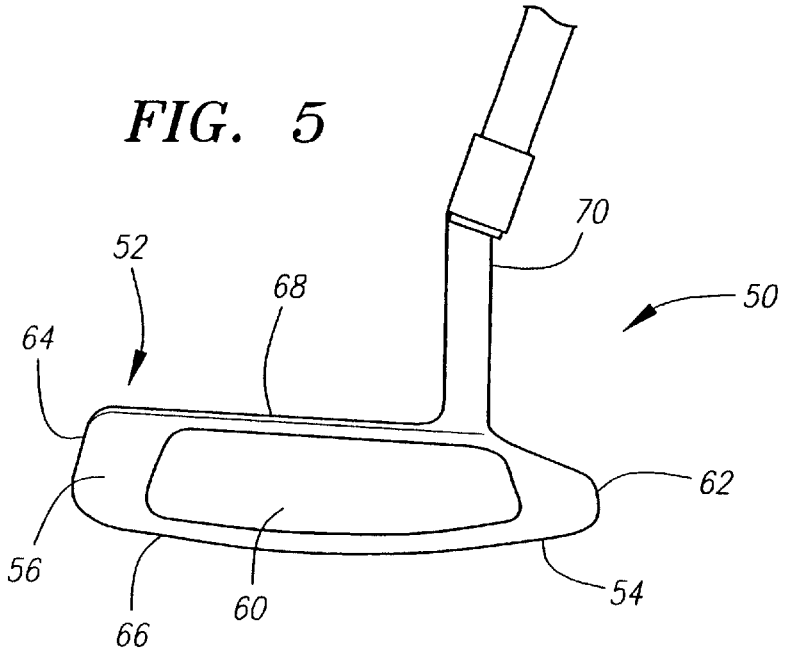
FIG. 5B
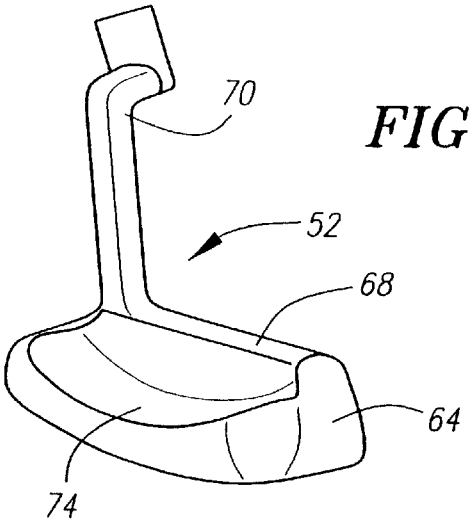
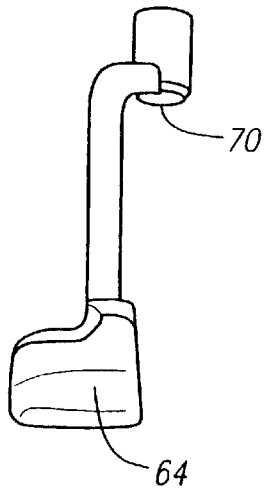
FIG. 5A
FIG. 5C
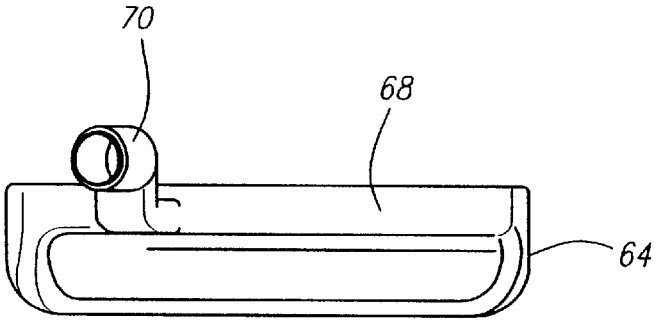

GOLF CLUB HEAD WITH A POLYMER INSERT

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with a polymer insert. More specifically, the present invention relates to a golf putter head with a polymer insert.

2. Description of the Related Art

Throughout the history of golf, which dates back to as early as 1457, various techniques have been used to enhance the hitting characteristics of golf club heads. Golf club heads having inserts for the striking portion have been used at least as far back as 1880's when leather face irons were manufactured in Scotland. Golfer's in the 1890's were able to purchase putters with faces composed of gutta percha. More recently, inserts composed of various materials and shapes have been put forth by the creative geniuses of the golf industry to provide golfers with better feel and control of the golf ball.

One example is an ODYSSEY® putter having a STRONOMIC® insert that is disclosed in Magerman et al., U.S. Pat. No. 5,575,472 for a Golf Putter Head Having Face Insert And Method Of Forming The Same. The Magerman et al. Patent discloses a putter head with a recess into which is poured or inserted a resinous material which cures and is subsequently milled to produce the putter.

Another example is Pond, U.S. Pat. No. 5,524,331 for a Method For Manufacturing Golf Club Head With Integral Inserts that discloses a method for casting a graphite-epoxy composite insert within a recess of a face of a metal club head. The golf club head of the Pond Patent is directed at displacing the weight away from the center and increasing the moment of inertia.

Another example is Schmidt et al., U.S. Pat. No. 5,485,997, for a Golf Putter Head With Face Plate Insert Having Heightened Medial Portion, that discloses a putter head with a face plate composed of a non-metallic material such as an elastomer. The overall construction of the putter head of the Schmidt et al. Patent is directed at enlarging the sweet spot and improving the peripheral weighting.

Yet another example is found in Baker et al., U.S. Pat. No. 5,931,743 for a Putter Having Club Head With A Golf-Ball Engagement Insert And A Shaft Rearwardly Of The Insert which discloses a putter with a center shaft and an insert composed of a thermoplastic polyurethane. Another example is Jepson et al., U.S. Pat. No. 3,937,474 for a Golf Club With Polyurethane Insert, which discloses a wood having an insert on its striking face that is composed of a polyurethane formed from a tolylene diisocyanate polyether terminated prepolymer and a curing agent. The hardness of this insert varies from 40 to 75 shore D, and a Bashore Resiliometer of 17 or above. The polyurethane insert is claimed to impart additional energy to the golf ball during a golf hit.

Chen et al., U.S. Pat. No. 5,743,813 for a Golf Club Head discloses a wood composed of stainless steel with a three layer face having a first stainless steel layer, an elastic layer and a second stainless steel layer. The three-layer face does not absorb the hitting force when a golf ball is hit.

Fisher, U.S. Pat. No. 5,458,332, for a Golf Putter Head With A Cushioning Face, discloses a set of golf putters, each having an insert composed of polyurethane with a hardness in the range of 70 Shore A to about 80 Shore D. The rebound factor of each of the inserts is in the range of 12.5% to 50%, and the inserts are formulated to effect a reproducible direct linear relationship between the rebound factor and the distance of the putt.

Yet another example is McGeeney et al, European Patent Application Number 0891790 for a Multiple Density Golf Club Head And Method Of Manufacturing which discloses a putter with a central segment composed of a thermoplastic elastomer or a thermoset polymer. Possible thermoplastic elastomers include styrene co-polymers, co-polyesters, polyurethanes, polyamides, olefins and vulcanates. Possible thermoset polymers include epoxides, polyimides and polyester resins. The central segment has a minimum durometer hardness of Shore D 50. The central segment is bounded by metallic heel and to portions. However, the use of inserts is restrained in order to maintain the integrity of the game of golf.

In this regard, the Rules of Golf, established and interpreted by the United States Golf Association ("USGA") and The Royal and Ancient Golf Club of Saint Andrews, sets forth certain requirements for a golf club head. The requirements for a golf club head are found in Rule 4 and appendix II. A complete description of the Rules of Golf are available on the USGA web page at www.usga.org. Although the Rules of Golf do not expressly state specific parameters for an insert for a putter, the Rules of Golf have been interpreted to establish that an insert for a putter should have a Shore A hardness greater than 87±2%, have a constant thickness, have a thickness of at least 0.125 inches, and not act like a spring.

The prior art is absent a golf club head that has an insert composed of a material that is soft, but above the USGA requirements, and has a sufficient Bayshore rebound to provide a golf ball with the necessary distance to reach the hole.

BRIEF SUMMARY OF THE INVENTION

The present invention provides a golf club head with an insert that is composed of a soft material yet has a good Bayshore rebound and a low tan θ. The present invention is able to accomplish this by using a material composed of a polyurethane formed from the reaction of at least one diisocyanate prepolymer and a curing agent.

One aspect of the present invention is a golf club head including a club head body having a front face with a recess therein, and an insert. The insert is disposed within the recess and is composed of a thermoset polyurethane having a shore D hardness in the range of 42 to 55, and a Bayshore rebound in the range of 50 to 70.

The thermoset polyurethane may be formed from a p-phenylene diisocyanate ("PPDI")-based polyurethane prepolymer and a curing agent. Alternatively, the thermoset polyurethane may be formed from a toluene diisocyanate ("TDI") based polyurethane prepolymer and a curing agent. Further, the thermoset polyurethane may be formed from a TDI-based polyurethane prepolymer, a PPDI-based polyurethane prepolymer, and a curing agent. The PPDI-based polyurethane insert has a lower tan δ value. The tan δ value measures the amount of energy a material loses as heat upon a high distortion or impact event (i.e. hysteresis).

Another aspect of the present invention is a golf club head including a club head body having a recess therein, and an disposed within the recess. The insert is composed of a thermoset polyurethane formed from a PPDI-terminated polyester prepolymer in an amount up to 90 parts, a PPDI-terminated polyether prepolymer in an amount up to 90 parts, 10 to 40 parts of a TDI polyurethane prepolymer, and at least one curing agent. The curing agent is selected from the group consisting of a diol, a mixture of diols, a triol, a mixture of triols, a hydroquinone, a mixture of hydroquinones, a diamine, a mixture of diamines, an oligomeric diamine, and any mixture thereof.

Yet another aspect of the present invention is a golf club head that includes a club head body and an insert. The club head body includes a front face, a toe to one side of the front face and a heel to the other side of the front face, and a sole. The front face has a recess therein for the insert. The insert is composed of a polymer material that has a shore D hardness in the range of 42 to 55, and a Bayshore rebound in the range of 50 to 70.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 3 is a front view of another embodiment of the golf club head of the present invention with an insert in the recess of the club head body.

FIG. 3A is a side view of the club head of FIG. 3.

FIG. 3B is a rear view of the club head of FIG. 3.

FIG. 3C is a top view of the club head of FIG. 3.

FIG. 5 is a front view of another embodiment of the golf club head of the present invention with an insert in the recess of the club head body.

FIG. 5A is a side view of the club head of FIG. 5.

FIG. 5B is a rear view of the club head of FIG. 5.

FIG. 5C is a top view of the club head of FIG. 5.

DETAILED DESCRIPTION OF THE INVENTION

Figure 1:
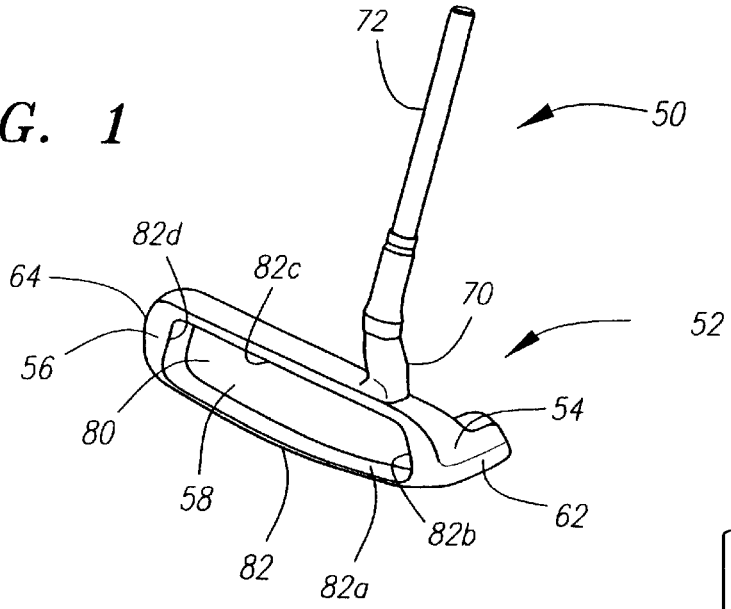
FIG. 1 is a perspective view of one embodiment of the golf club head of the present invention without an insert in the recess of the club head body.
Figure 1B:
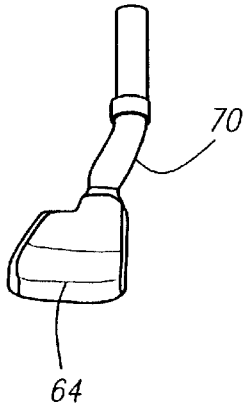
FIG. 1B is a side view of the club head of FIG. 1.
Figure 1A:
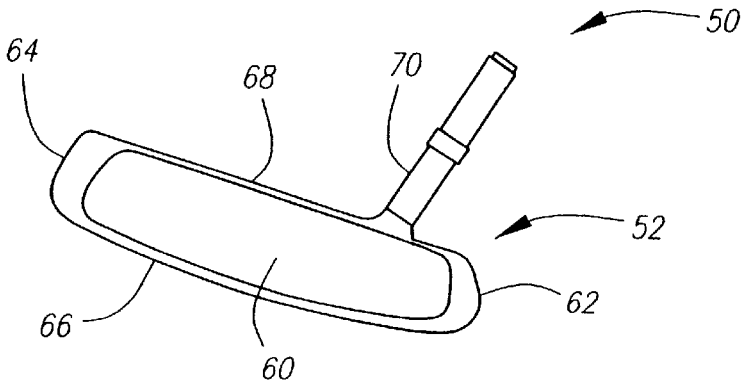
FIG. 1A is a front view of the club head of FIG. 1 with the insert placed therein.
Figure 1D:
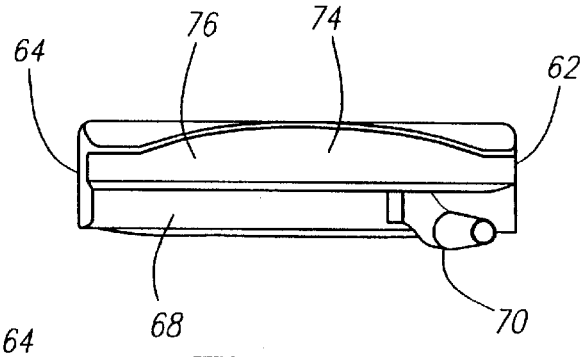
FIG. 1D is a top view of the club head of FIG. 1.
Figure 1C:
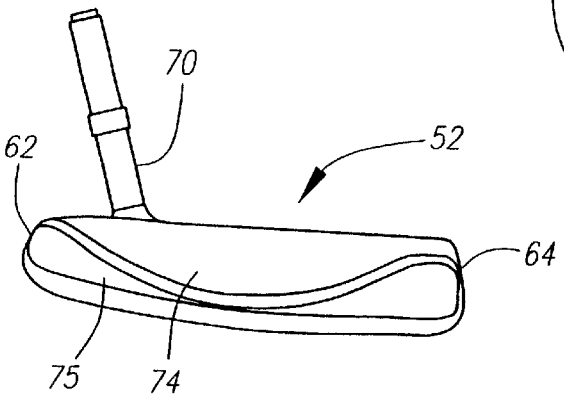
FIG. 1C is a rear view of the club head of FIG. 1.

As shown in FIGS. 1 through 1D, a putter of the present invention is generally designated 50. The putter 50 includes a club head 52 having a body 54 with a front face 56 with a recess 58 therein. The club head 52 of the present invention also includes a polymer insert 60 disposed within the recess 56. The polymer insert 60 extends along most of the face 56 from a heel 62 of the club head 52 to a toe 64 of the club head 52, and from a sole 66 of the club head 52 to a crown 68 of the club head 52. The club head 52 also has a hosel 70 for connection to a shaft 72. Opposite of the front face 56 of the club head 52 is a rear 74 of the club head 52.

The body 54 of the club head 52 is preferably composed of a metallic material such as tungsten or stainless steel. However, those skilled in the pertinent art will recognize that the body 54 may be composed of other materials without departing from the scope and spirit of the present invention. Further, the non-insert portion of the face 56 may be smooth or textured to provide a consistent or non-consistent surface with the exterior surface of the insert. Additionally, the body 54 may be specifically weighted to provide a specific center of gravity for the putter 50.

FIGS. 2–6C illustrate various embodiments of putters 50 of the present invention. Each of the putters 50 of FIGS. 2–6C has a club head 52 with a body 54 and a polymer insert 60 disposed within a recess 58 of the body 54. The putters 50 illustrated in FIGS. 1–6C are flanged blade, mallet and semi-mallet putters, however, those skilled in the art will recognize that other similar putter designs may be utilized without departing from the scope and spirit of the present invention.

Referring specifically to FIG. 1, the recess 58 of the body 54 is defined by a recess face wall 80 which is substantially parallel with the polymer insert 60, and a recess edge wall 82 which is substantially perpendicular to the recess face wall 80. The recess face wall 80 defines the depth of the recess 58 which will determine the thickness of the polymer insert 60. The recess edge wall 82, as shown in FIG. 1, is composed of a bottom recess edge wall 82*a*, a heel recess edge wall 82*b*, a top recess edge wall 82*c* and a toe recess edge wall 82*d*. The recess edge wall 82 defines the shape of the recess 58, and the length of the recess edge wall 82 is determined by the depth of the recess 58. In a preferred embodiment, the polymer insert 60 will engage the recess edge wall 82 as described below.

The putter 50 of FIGS. 1–1D is a flanged blade style putter. The rear 74 of the club head 52 has a rear wall 75 and a flanged portion 77. The polymer insert 60 occupies more than 80% of the area of the face 56 of the club head 52.

Figure 2:
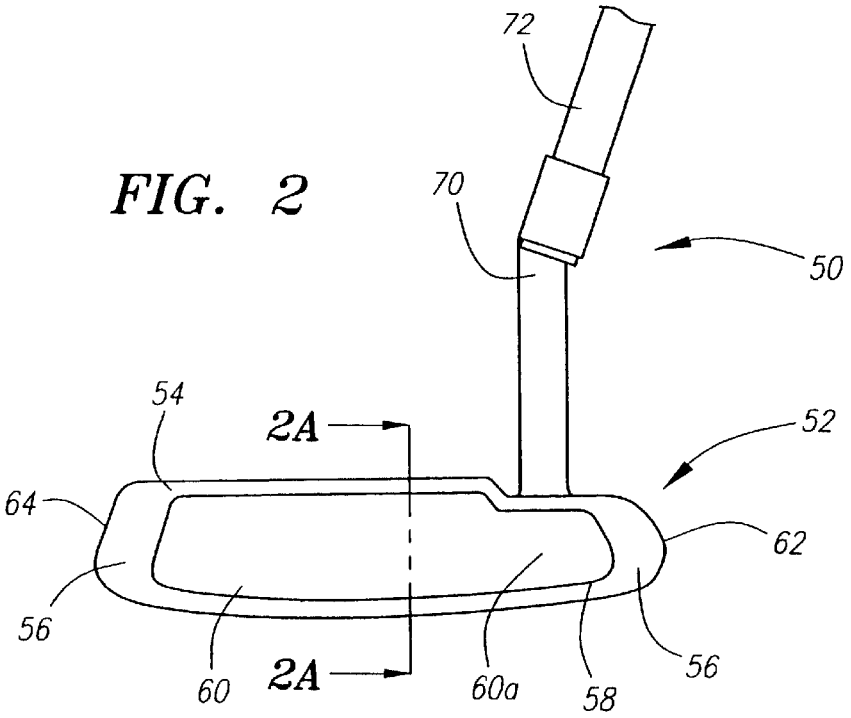
FIG. 2 is a front view of another embodiment of the golf club head of the present invention with an insert in the recess of the club head body.
Figure 2B:
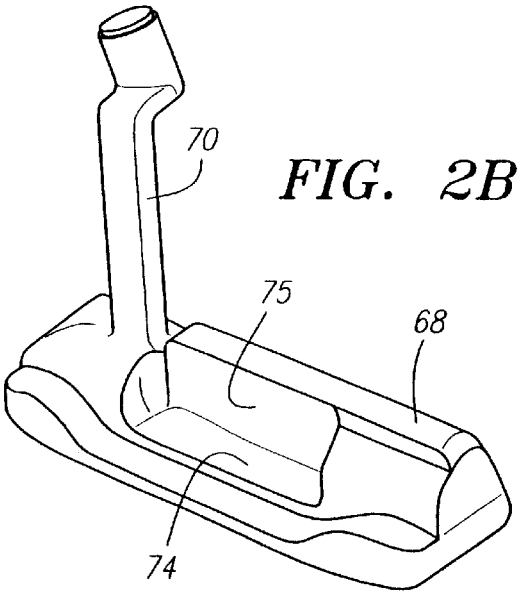
FIG. 2B is a rear view of the club head of FIG. 2.
Figure 2A:
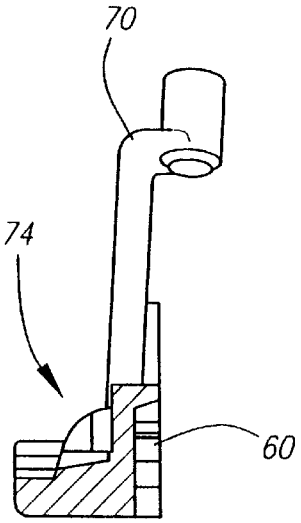
FIG. 2A is a partial cross-sectional side view of the club head of FIG. 2.
Figure 2C:
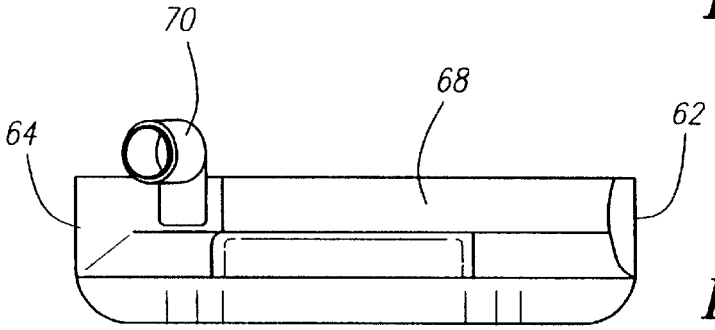
FIG. 2C is a top view of the club head of FIG. 2.

The putter 50 of FIGS. 2–2C is also a blade style putter, however, it has an offset hosel 70, and a polymer insert 60 with a panhandle portion 60*a*. The polymer insert 60 is one-piece, including the panhandle portion 60*a*. It is apparent from FIG. 2 that this putter 50 has a larger area of the non-insert portion of the face 56 than the embodiment shown in FIG. 1A. However, the polymer insert 60 still occupies at least 75% of the face 56 of the club head 52.

Figure 4:
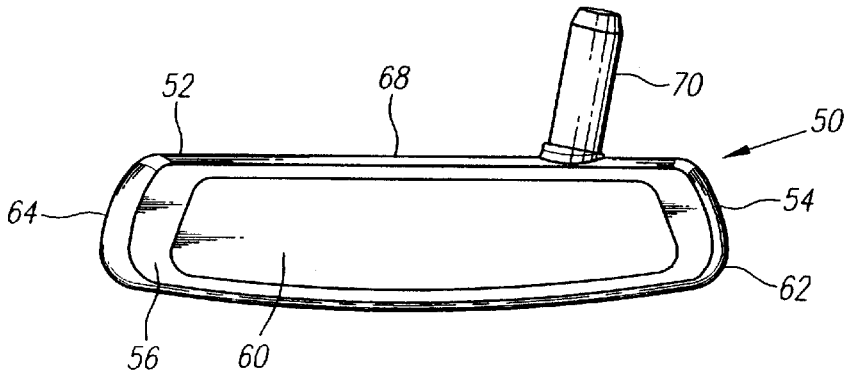
FIG. 4 is a front view of another embodiment of the golf club head of the present invention with an insert in the recess of the club head body.
Figure 4A:
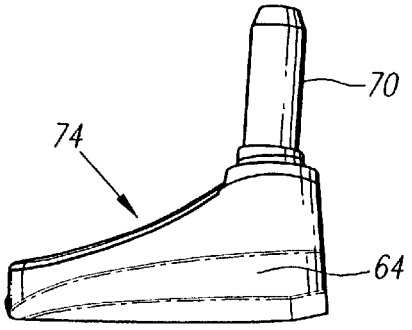
FIG. 4A is a side view of the club head of FIG. 4.
Figure 4B:
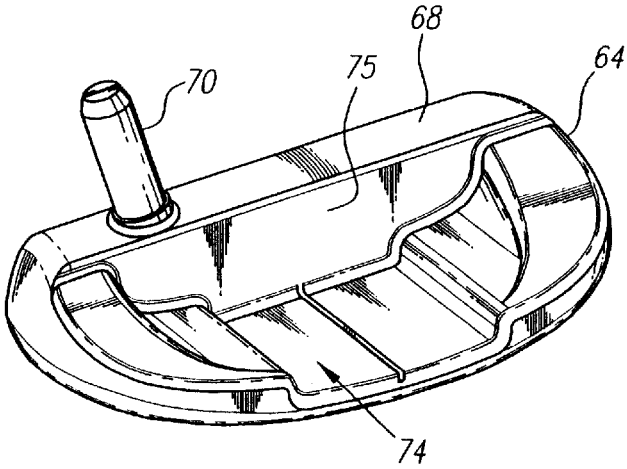
FIG. 4B is a rear view of the club head of FIG. 4.
Figure 4C:
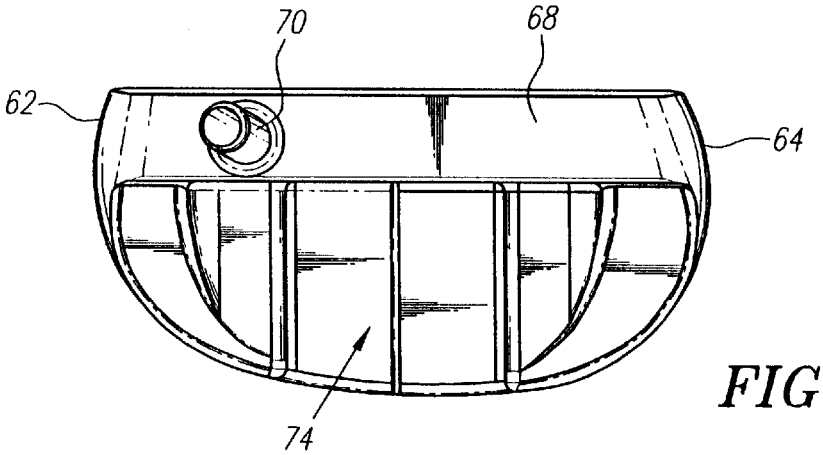
FIG. 4C is a top view of the club head of FIG. 4.

The putter 50 of FIGS. 3–3C is a half-mallet style putter with an offset hosel 70. The polymer insert 60 has a trapezoidal shape with parallel sides and a curved bottom portion. It is apparent from FIG. 3 that the toe end and heel end of the face 56 of this putter 50 has a large area of the non-insert portion. The putter of FIGS. 4–4C is also a half-mallet style putter, however, it does not have an offset hosel 70.

Figure 6:
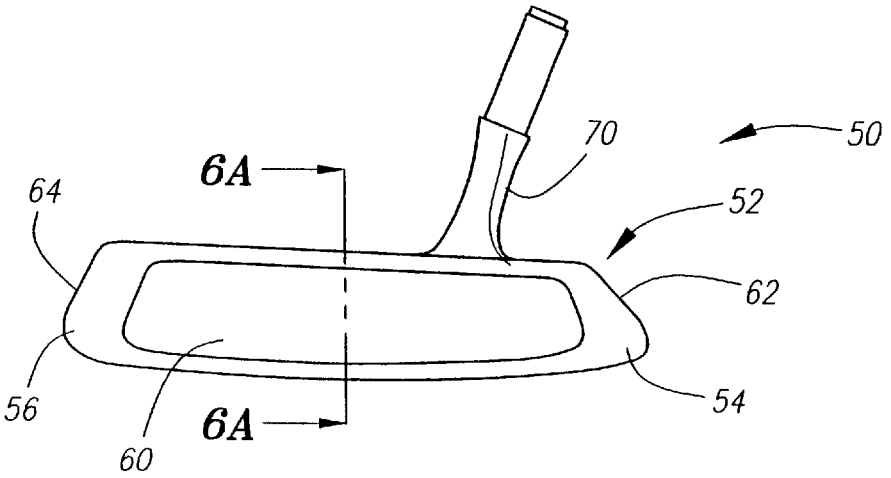
FIG. 6 is a front view of another embodiment of the golf club head of the present invention with an insert in the recess of the club head body.
Figure 6B:
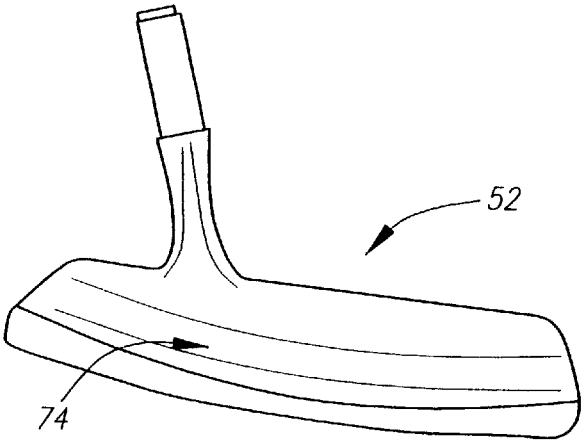
FIG. 6B is a rear view of the club head of FIG. 6.
Figure 6A:
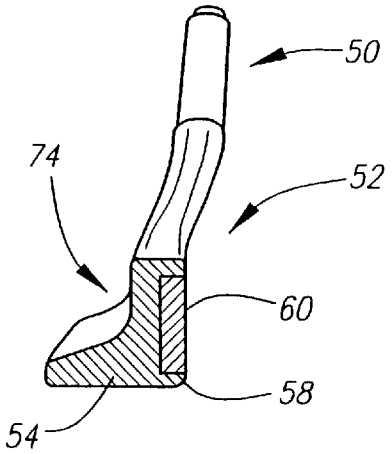
FIG. 6A is a partial cross-sectional side view of the club head of FIG. 6.
Figure 6C:
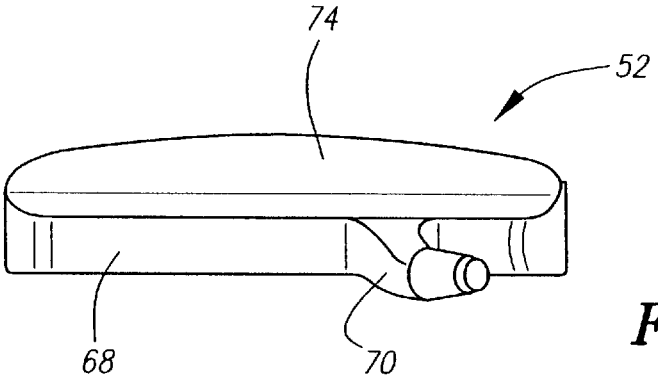
FIG. 6C is a top view of the club head of FIG. 6.

The putter 50 of FIGS. 5–5C is a flanged-blade style putter with an offset hosel 70. The polymer insert 60 has a trapezoidal shape with parallel sides and a curved bottom portion. It is apparent from FIG. 5 that the toe end and heel end of the face 56 of this putter 50 has a largest area of the non-insert portion However, the polymer insert 60 still occupies at least 60% of the face 56. The putter of FIGS. 6–6C is a blade style putter. As shown in FIG. 6A, the polymer 60 only occupies a small portion of the volume of the club head 52 compared to the body 54 of the club head 52. The polymer insert 60 occupies between 10 to 25% of the volume of the club head 52.

The polymer inserts 60 of FIGS. 1–6C vary in shape and thickness depending on the design of the putter 50. A preferred shape of the polymer insert 60 is a trapezoidal shape with curved corners. An alternative shape is a trapezoidal shape with a panhandle as illustrated in FIG. 2.

Figure 7:
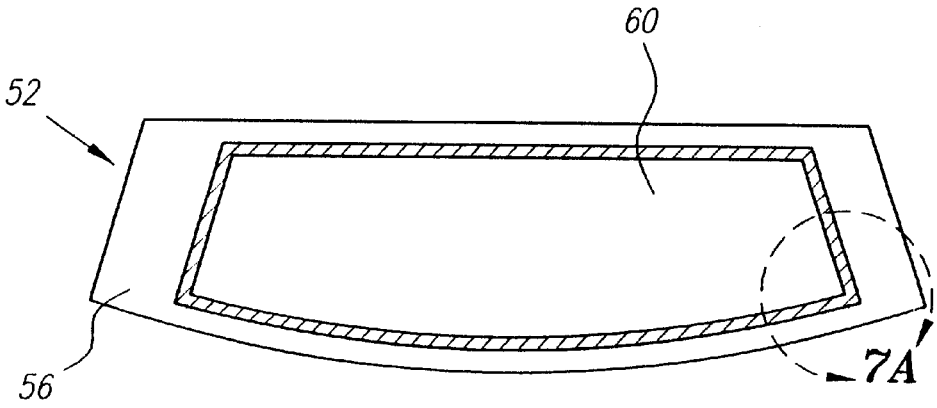
FIG. 7 is an isolated front view of an insert disposed within a recess of the face of a golf club head of the present invention.
Figure 7A:
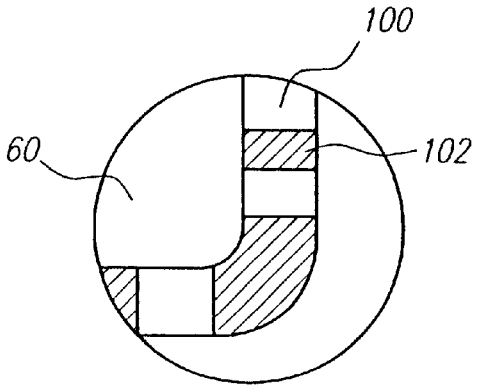
FIG. 7A is an enlarged view of the circle A of FIG. 7.
Figure 7B:
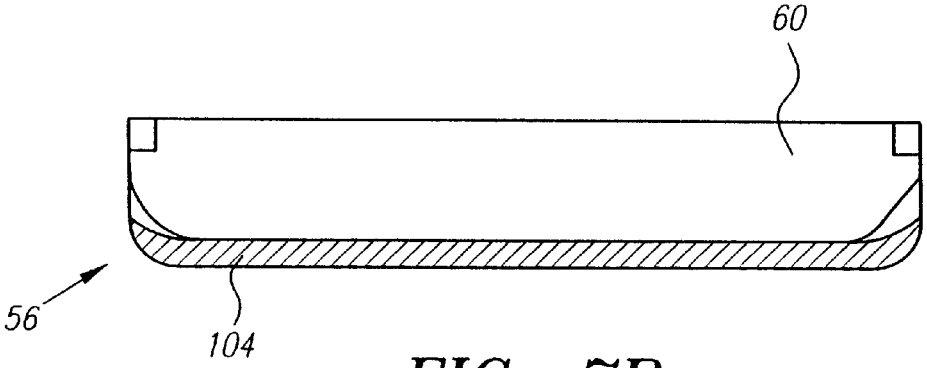
FIG. 7B is an isolated view of the insert within the recess of the club head, and bonded to the recess wall by an epoxy.
Figure 8:
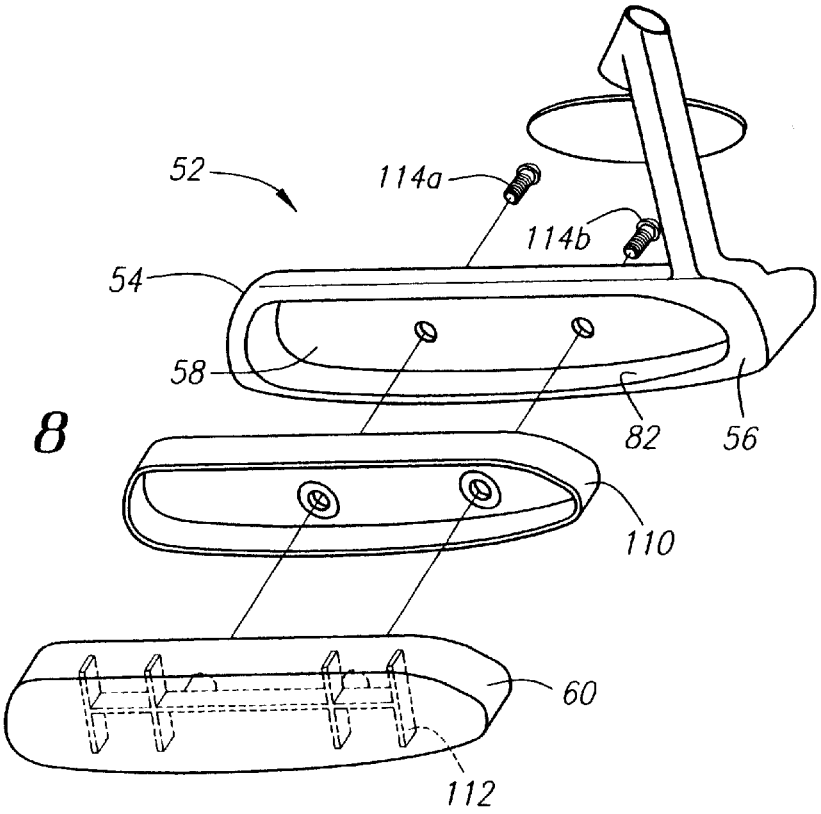
FIG. 8 is an exploded view of another embodiment of attaching the insert to the club head.
Figure 9:
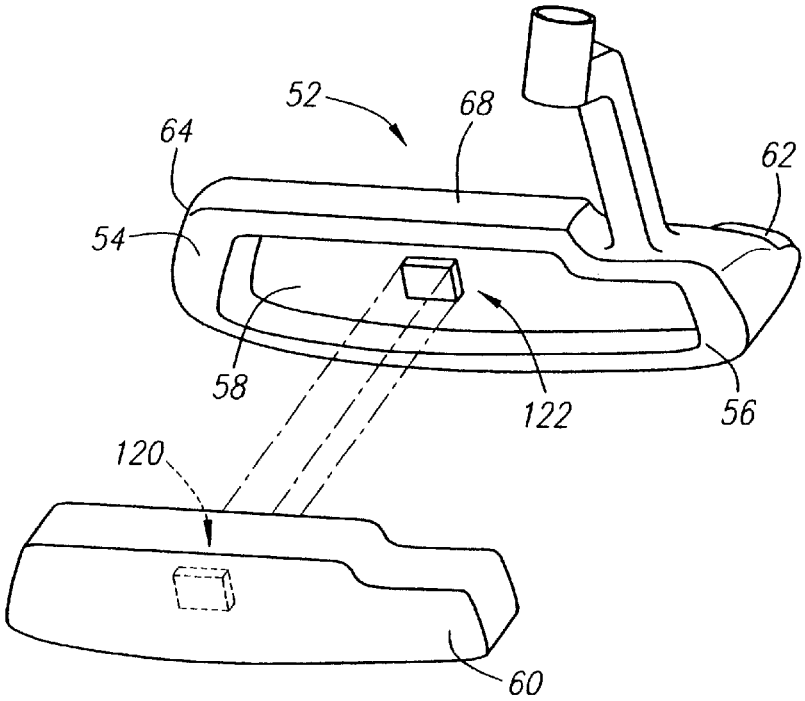
FIG. 9 is an exploded view of yet another embodiment of attaching the insert to the club head.

FIGS. 7–9 illustrate various means of attaching the polymer insert 60 to the club head 54. As shown in FIGS. 7, 7A and 7B, the polymer insert 60 is held within the recess 58 by integral tabs 100 on the perimeter of the polymer insert 100, an adhesive epoxy 102 applied into the spacings between the tabs 100, and an adhesive epoxy 104 applied to the recess frontal wall 80 and/or the rear surface of the polymer insert 60. A more detailed description of this attachment means is set forth in co-pending patent application Ser. No. 09/389,798, entitled A Golf Club Head With An Insert Having Integral Tabs, filed on Sep. 3, 1999, which is hereby incorporated by reference in its entirety.

Another attachment means is illustrated in FIG. 8. As shown in FIG. 8, a gasket 110 is disposed between the polymer insert 60 and frontal recess wall 80. The polymer insert 60 also has an integral brace 112 with couplings 113*a–b* for threadingly receiving bolts 1 14*a–b* which are set through the rear wall 76 of the club head 52. In this manner, the polymer insert 60 is properly aligned and securely attached to the club head 52.

Yet another attachment means is illustrated in FIG. 9. As shown in FIG. 9, the polymer insert has a square coupling 120 attached to its interior surface. This coupling 120 is mated with a corresponding projection 122 extending from the frontal recess wall 80 within the recess. In this manner, the polymer insert 60 is properly aligned and securely attached to the club head 52.

Figure 10:
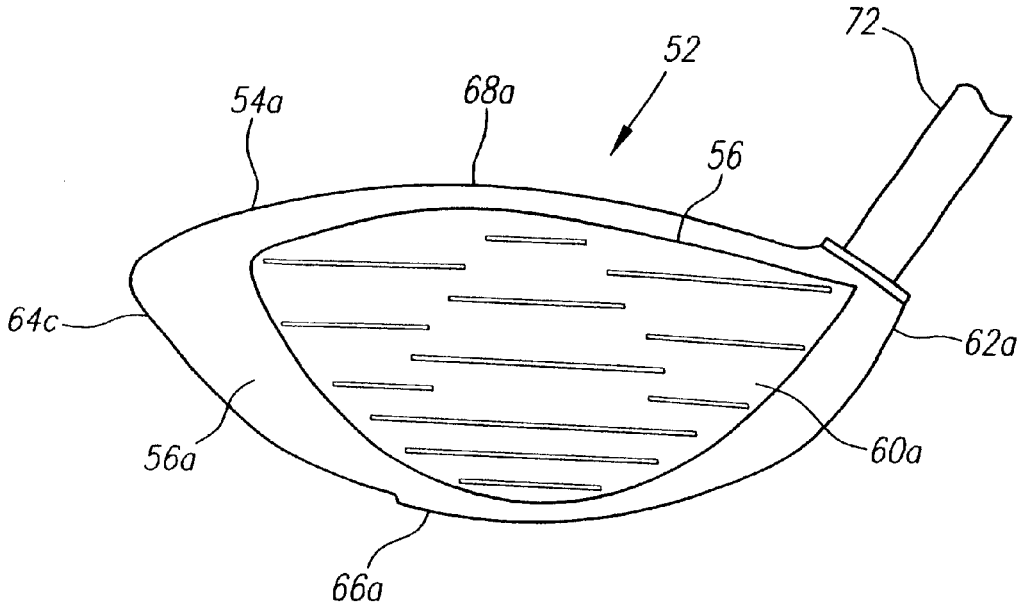
FIG. 10 is a front view of a wood club head with an insert of the present invention.
Figure 11:
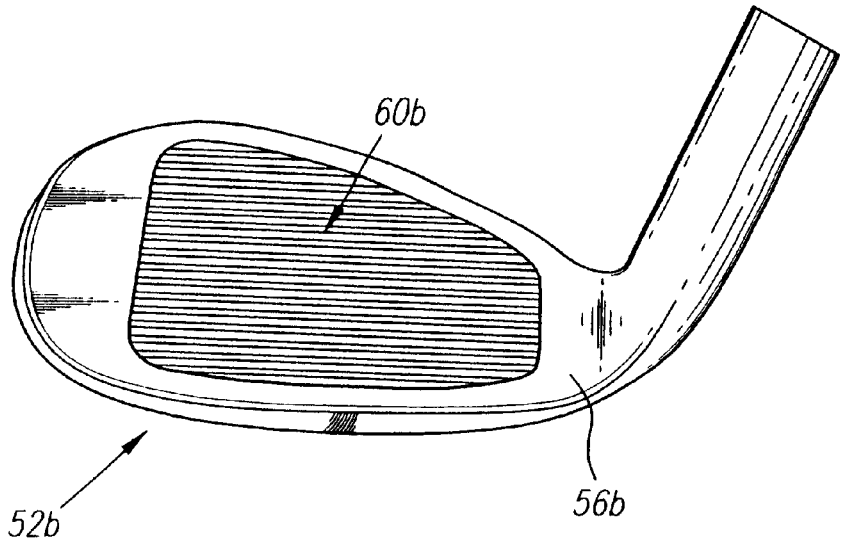
FIG. 11 is a front view of an iron club head with an insert of the present invention.

FIG. 10 is illustrates yet another utilization of the polymer insert 60*a* in a wood club head 52*a*. The polymer insert 60*a* occupies most of the face 56*a*, from the heel 62*a* to the toe 64*a*, and from the sole 66*a* to the crown 68*a* The body 54*a* of the club head 52*a* may be hollow, unlike the putters 50 of the previous embodiments. Further, the recess face wall, not shown, of the recess 58*a* will not abut the rear wall, not shown, unlike the putters 50 of the previous embodiments. The body 54*a* may be composed of titanium, or steel. FIG. 11 illustrates a further embodiment where the polymer insert 60*b* is used on the face 56*b* of an iron club head 52*b*.

The main aspect of the present invention is the polymer insert 60 which is composed of a polymer material having a predetermined hardness and a predetermined Bayshore rebound as further described below. Preferably, the polymer insert 60 is composed of a polyurethane material formed from a PPDI prepolymer and a curing agent. An alternative embodiment has the polymer insert composed of a polyurethane formed from a blend of diisocyanate prepolymers. The blend of diisocyanate prepolymers preferably includes at least one TDI-based polyurethane prepolymer and at least one other diisocyanate-based polyurethane prepolymer. In a preferred embodiment, the blend of diisocyanate prepolymers includes at least one PPDI-based polyurethane prepolymer and at least one TDI-based polyurethane prepolymer. Alternative embodiments have a blend which includes at least two different PPDI-based polyurethane prepolymer and at least one TDI-based polyurethane prepolymer. Yet further embodiments may include at least one TDI-based polyurethane prepolymer and at least one MDI-based polyurethane prepolymer. Those skilled in the pertinent art will recognize that multiple variations of diisocyanate prepolymers may be utilized without departing from the scope and spirit of the present invention.

The polyurethane utilized in the preferred embodiment of the present invention is composed of only a PPDI terminated polyether prepolymer and a diol blend curing agent. A preferred PPDI terminated polyether prepolymer is available from Uniroyal Chemical Company of Middlebury, Conn. under the tradename ADIPRENEO® LFPX 950. Another alternative embodiment is composed of a blend of a TDI-based prepolymer, a second diisocyanate-based polyurethane prepolymer and a curing agent. The TDI-based prepolymer is preferably formed from TDI and a polyether polyol having a molecular weight between 250 and 5000. The second diisocyanate-based polyurethane prepolymer is preferably a PPDI-based prepolymer formed from PPDI and a polyester polyol, preferably a polycaprolactone. The prepolymer blend is cured with a curing agent. The curing agent, or curative, may be a diol (e.g., 1,4 butane diol, trimethylpropanol), a mixture of diols (e.g., 1,4 butane diol and ethylene glycol, or other suitable glycols), a hydroquinone, a mixture of hydroquinones, a triol, a mixture of triols, a diamine, a mixture of diamines, an oligomeric diamine, a triamine, or a blend of some or all of these materials. Preferably, the curing agent is a blend of a diamine and a mixture of diols.

In an alternative embodiment, the blend of prepolymers includes three diisocyanate-based polyurethane prepolymers. In this embodiment, the TDI-based prepolymer is preferably formed from TDI and a polyether polyol. The second diisocyanate-based polyurethane prepolymer is preferably a PPDI-based prepolymer formed from PPDI and a polyester polyol, preferably a polycaprolactone. The third diisocyanate-based polyurethane prepolymer is a PPDI-based prepolymer formed from PPDI and a polyether polyol. Preferably, the curing agent is a blend of a diamine and a mixture of diols. As mentioned above, alternative embodiments may have variations of the dual blend or the tri-blend, and may use a TDI-based polyurethane prepolymer with other non-PPDI-based polyurethane prepolymers.

The TDI-based prepolymer may range from 10 to 40 percent of the polyurethane prepolymer blend. Preferably, the TDI-based prepolymer is 30 percent of the polyurethane prepolymer blend. A preferred TDI based prepolymer is a TDI terminated polyether prepolymer available from Uniroyal Chemical, under the tradename ADIPRENE® LF950.

The dual blend and tri-blend formulations will preferably contain a PPDI terminated polyester prepolymer and/or a PPDI terminated polyether prepolymer. A preferred PPDI terminated polyester prepolymer is available from Uniroyal Chemical under the tradename ADIPRENE® LFPX 2950. A preferred PPDI terminated polyether prepolymer is available from Uniroyal Chemical under the tradename ADIPRENE® LFPX 950.

The polyurethane prepolymer blend may have 10 to 40 parts of a TDI terminated polyether prepolymer blended with 60 to 90 parts of a PPDI terminated polyether prepolymer. Alternatively, the polyurethane prepolymer blend may have 10 to 40 parts of a TDI terminated polyether prepolymer blended with 60 to 90 parts of a PPDI terminated polyester prepolymer. Further, the polyurethane prepolymer blend may have 10 to 40 parts of a TDI terminated polyether prepolymer blended with 5 to 90 parts of a PPDI terminated polyether prepolymer and 5 to 90 parts of a PPDI terminated polyester prepolymer. More specific blend formulations are set forth in the Examples below.

The polymer insert 60 of the present invention is most preferably composed of a polyurethane formed from a PPDI-terminated polyether polyurethane prepolymer, and cured with a blend of 1,4 butane diol and glycols. A suitable blend of diol and glycols is available from Uniroyal Chemical under the tradename VIBRACURE® A250. A diamine curing agent may also be utilized. A suitable diamine is toluene ethylene diamine available from Albemarle Corporation of Baton Rouge, La. under the tradename ETHACURE® 100. Other agents which may be utilized during the curing process include dimethylthio-2,4-toluenediamine (such as EHTACURE® 300 available from Albemarle Corporation); trimethyl glycol di-p-aminobenzoate (such as VERSALINK® 740M available from Air Products and Chemicals, Inc., Allentown, Pa.); cyclohexane dimethanol; hydroquinone-bis-hydroxyethyl ether; phenyldiethanol amine mixture (such as VIBRACURE® A931 available from Uniroyal Chemical); methylene dianiline sodium chloride complex (such as CAYTOR® 31 available from Uniroyal Chemical ); and/or prionene amine. This list of preferred agents (including chain extenders, cross-linkers and curing agents) is not meant to be exhaustive, as any suitable (preferably polyfunctional) chain extender, cross-linker, or curing agent may be used.

The curing agent mixture for the polymer insert 60 of the present invention may have numerous variations. In a preferred embodiment, the curing agent is composed only of a diol blend such as VIBRACURE® 250. Alternatively, a diamine component may be utilized such as a blend of different diamines such as a blend of EHTACURE® 100 with ETHACURE® 300.

The ratio of the polyurethane prepolymer blend to curing agent is determined by the nitrogen-carbon-oxygen group ("NCO") content of the polyurethane prepolymer blend. For example, the NCO content of the PPDI-terminated polyether is preferably in the range of 5.0% to 8.0%. The NCO content of the TDI-terminated polyether or TDI-terminated polyester is preferably in the range of 4.0% to 9.0%. The NCO content of the PPDI-terminated polyester is preferably in the range of 2.0% to 6.0%. The NCO content of the polyurethane prepolymer blend ranges from 2% to 8% of the polyurethane prepolymer blend. The amount of curing agent should correspond to 90% to 110% of the mol equivalence of the NCO content of the polyurethane prepolymer blend. The weight ratio of the polyurethane prepolymer blend to the curing agent is preferably in the range of about 10:1 to about 30:1.

Prior to curing, the polyurethane prepolymer blend and curing agent are preferably stored separately. The polyurethane is formed by first heating and mixing the polyurethane prepolymer blend with the curing agent in a mold, and then curing the mixture by applying heat and pressure for a predetermined time period to form a sheet of material with a predetermined thickness. The thickness of the polymer insert 60 may vary depending on its application. A preferred thickness for a putter 50 is in the range of 0.125 to 0.500 inches. A preferred thickness is 0.250 inches. The thickness of the polymer insert 60 is increased or decreased to influence the feel to the golfer during impact with a golf ball, and the distance the golf ball will travel after impact. The absence of a catalyst (e.g. dibutyl tin dilaurate, a tertiary amine, etc.) allows for better control of the process in forming a sheet with a uniform thickness. Furthermore, additives such as colorants may also be added to the mixture.

The polyurethane prepolymer blend material is preferably degassed and warmed in a first holding container prior to processing of the mold sheet. The processing temperature for the polyurethane prepolymer blend is preferably in the range of about 100–220° F., and most preferably in the range of about 120–200° F. The polyurethane prepolymer blend is preferably flowable from the first holding container to a mixing chamber in a range of about 200–1100 grams of material per minute, or as needed for processing. In addition, the polyurethane prepolymer blend material may be agitated in the first holding container, in the range of 0–250 rpm, to maintain a more even distribution of material and to eliminate crystallization.

The curing agent is preferably degassed and warmed in a second holding container prior to processing. The processing temperature for the curative is preferably in the range of about 50–230° F., and most preferably in the range of about 80–200° F. The curing agent is preferably flowable from the second holding container to the mixing chamber in the range of about 15–75 grams of material per minute, or as needed.

The polyurethane prepolymer blend and curative mixture are preferably added to the common mixing chamber at a temperature in the range of about 160–220° F. A colorant material, such as, for example, titanium dioxide, barium sulfate, and/or zinc oxide in a glycol or castor oil carrier, and/or other additive material(s) as are well known in the art, may be added to the common mixing chamber. The amount of colorant material added is preferably in the range of about 0–10% by weight of the combined polyurethane prepolymer blend and curative materials, and more preferably in the range of about 2–8%. Other additives, such as, for example, polymer fillers, metallic fillers, and/or organic and inorganic fillers (e.g. polymers, balata, ionomers, etc.) may be added as well to increase the specific gravity of the polyurethane cover 16 of the present invention. It was discovered that the addition of barytes (barium sulfate) or a blend of barytes and titanium dioxide (preferably added in a carrier glycol and/or castor oil) to the mixture, in the amounts of about 0.01–30%, may add sufficient weight to the polymer insert 60. The entire mixture may be agitated in the mixing chamber in the range of about 1 to 250 rpm prior to molding.

The mixture is poured into a vertical mold for curing into a sheet having a predetermined thickness. The sheet is then cut into inserts as described in co-pending U.S. patent application Ser. No. 09/389,789, previously incorporated by reference.

TABLE FIVE

| Insert | Polyurethane prepolymer | | | | | Bayshore | Shore D |
|---|---|---|---|---|---|---|---|
| Ex. No. | TDI | PPDI-1 | PPDI-2 | PPDI-3 | PPDI-4 | Rebound | Hardness |
| 1 | | | | 100 | | 57 | 45 |
| 2 | 30 | | 20 | 50 | | 52 | 52 |
| 3 | 30 | | | | 70 | 55 | 47 |
| 4 | 30 | | | | 70 | 55 | 47 |
| 5 | 30 | 50 | 20 | | | 52 | 47 |
| 6 | 30 | | | | 70 | 55 | 47 |
| 7 | 30 | 50 | 20 | | | 52 | 47 |
| 8 | 30 | | 20 | 50 | | 52 | 53 |
| 9 | 30 | 70 | | | | 55 | 53 |
| 10 | 20 | 80 | | | | 55 | 47 |
| 11 | 30 | 70 | | | | 55 | 47 |
| 12 | 30 | 70 | | | | 55 | 47 |

Table Five sets forth the properties and compositions of various polymer inserts 60 composed of a thermoset polyurethane. The number of parts of each polyurethane prepolymer for each of the polymer inserts 60 is provided in columns 2 through 6. Column 2 includes the number of parts of the TDI-terminated polyether prepolymer, ADIPRENE° LF950. Column 3 includes the number of parts of the PPDI terminated polyether prepolymer, ADIPRENE® LFPX950. Column 4 includes the number of parts of the PPDI terminated polyester (polycaprolactone) prepolymer, ADIPRENE® LFPX2950. Column 5 includes the number of parts of the PPDI terminated polyether prepolymer, ADIPRENE® LFPX590. The difference between LFPX590 and LFPX950 is the NCO content and the molecular weight of the polyol (ether) backbone, with LFPX950 having a NCO content in the range of approximately 5.45% to approximately 5.75%, and LFPX590 having a NCO content in the range of approximately 5.6% to approximately 6.2%. Column 6 includes the number of parts of the PPDI terminated polyester (polycaprolactone) prepolymer, ADIPRENE® LFPX2952. The difference between LFPX2950 and LFPX2952 is the NCO content, with LFPX2950 having a NCO content in the range of approximately 3.55% to approximately 3.85%, and LFPX2952 having a NCO content in the range of approximately 4.45% to approximately 5.05%. The insert 60 of example 1 was cured with VIBRACURE 250. Each of the inserts for examples 2–9 and 11–12 were cured with a blend of curing agents. The blend of curing agents was composed of 50 parts ETHACURE 300 (a diamine curing agent) and 50 parts VIBRACURE A250 (a blend of a 1,4 butane diol and glycol). Example 10 of the polymer inserts 60 of the present invention was cured with a blend of 70 parts ETHACURE 300 and 30 parts VIBRACURE A250. The shore D hardness of the polymer insert 60 of present invention may range 42 degrees to 55 degrees.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf club bead comprising:

a club head body having a front face with a recess therein;

an insert disposed within the recess, the insert occupying more than 80% of the face and comprising a thermoset polyurethane formed from reactants comprising paraphenylene diisocyanate terminated polyether prepolymer having a nitrogen-carbon-oxygen group content ranging from 5% to 8%, and a blend of a diols, the thermoset polyurethane having a Shore D hardness in the range of 42–55, and a Bayshore rebound in the range of 51–70.

2. The golf club head according to claim 1 wherein the curing agent is a blend of diamine based curative and a diol based curative.

3. The golf club head according to claim 1 wherein the curing agent is selected from the group consisting of a diol, a mixture of diols, a triol, a mixture of triols, a hydroquinone, a mixture of hydroquinones, a diamine, a mixture of diamines, an oligomeric diamine, and any mixture thereof.

4. The golf club head according to claim 1 wherein the golf club head is a putter head.

5. The golf club head according to claim 1 wherein the shore D hardness is approximately 53.

6. The golf club head according to claim 1 wherein the insert has a bayshore rebound in the range of 55 to 70.

7. A golf club head comprising:

a club head body having a recess therein; and an insert disposed within the recess of the body, the insert comprising a thermoset polyurethane formed from reactants comprising a p-phenylene diisocyanate terminated polyester prepolymer in an amount up to 90 parts, a p-phenylene diisocyanate terminated polyether prepolymer in an amount of 50 parts to 90 parts, 10 parts to 40 parts of toulene diisocyanate polyurethane prepolymer, and at least one curing agent.

8. The golf club head according to claim 7 wherein the curing agent is selected from the group consisting of a diol, a mixture of diols, a triol, a mixture of triols, a hydroquinone, a mixture of hydroquinones, a diamine, a mixture of diamines, an oligomeric diamine, and any mixture thereof.

9. The golf club head according to claim 7 wherein the golf club head is a putter head.

10. The golf club head according to claim 7 wherein the shore D hardness is approximately 42 to approximately 55.

11. The golf club head according to claim 7 wherein the insert has a Bayshore rebound in the range of 55–70.

12. The golf club head according to claim 7 wherein the thermoset polyurethane is formed from reactants comprising 20 parts of a p-phenylene diisocyanate terminated polyester prepolymer, 50 parts of a p-phenylene diisocyanate terminated polyether prepolymer, 30 parts of a toluene diisocyanate polyurethane prepolymer.

13. The golf club head according to claim 7 wherein the thermoset polyurethane is formed from reactants comprising 70 to 80 parts of a p-phenylene diisocyanate terminated polyether prepolymer, 20 to 30 parts of a toluene diisocyanate polyurethane prepolymer.

14. A golf club head comprising:

a club head body comprising a front face, a toe end to one side of the face a heel end to the other side of the face, and a sole, the front face having a recess therein;

an insert disposed within the recess, the insert composed of a thermoset polyurethane material comprising a p-phenylene diisocyanate terminated polyester prepolymer in an amount of 10 to 90 parts, a p-phenylene diisocyanate terminated polyether prepolymer in an amount of 50 parts to 90 parts, 10 parts to 40 parts of toulene diisocyanate polyurethane prepolymer, and at least one curing agent from the group consisting of a blend of diols and a blend of diamines, the insert having a Shore D hardness in the range of 42 to 55 and a Bayshore rebound in the range of 55 to 70.

15. The golf club head according to claim 14 wherein the golf club head is a putter club head.

16. The golf club according to claim 14 wherein the golf club head is a wood.

17. The golf club head according to claim 14 wherein the golf club head is an iron.

18. The golf club head according to claim 16 wherein the club head body is composed of titanium.

19. The golf club head according to claim 15 wherein the club head body is composed of stainless steel.

* * * * *